US009048591B2

(12) United States Patent
Chang et al.

(10) Patent No.: US 9,048,591 B2
(45) Date of Patent: Jun. 2, 2015

(54) ELECTRICAL CONNECTOR HAVING A GROUNDING PLATE FOR SHIELDING

(71) Applicant: HON HAI PRECISION INDUSTRY CO., LTD., New Taipei (TW)

(72) Inventors: Yen-Chih Chang, New Taipei (TW); Tzu-Yao Hwang, New Taipei (TW); Ke-Hao Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 1 day.

(21) Appl. No.: 14/079,656

(22) Filed: Nov. 14, 2013

(65) Prior Publication Data

US 2014/0134853 A1 May 15, 2014

(30) Foreign Application Priority Data

Nov. 14, 2012 (TW) ..... 101142417 A

(51) Int. Cl.
*H01R 12/00* (2006.01)
*H01R 13/6597* (2011.01)
*H01R 12/71* (2011.01)

(52) U.S. Cl.
CPC ..... *H01R 13/6597* (2013.01); *H01R 12/716* (2013.01)

(58) Field of Classification Search
CPC ..... H01R 12/716; H01R 12/71; H01R 12/52; H01R 13/2442; H01R 13/6599
USPC ..... 439/68
See application file for complete search history.

(56) References Cited

U.S. PATENT DOCUMENTS

| | | | | |
|---|---|---|---|---|
| 6,390,833 | B1 * | 5/2002 | Chang | 439/108 |
| 7,108,566 | B2 * | 9/2006 | Kressmann et al. | 439/701 |
| 8,851,904 | B2 * | 10/2014 | Chang et al. | 439/71 |
| 2013/0217261 | A1 * | 8/2013 | Chen et al. | 439/499 |
| 2014/0154892 | A1 * | 6/2014 | Zantout et al. | 439/65 |

FOREIGN PATENT DOCUMENTS

CN 202194452 U 9/2011

* cited by examiner

*Primary Examiner* — Jean F Duverne
(74) *Attorney, Agent, or Firm* — Wei Te Chung; Ming Chieh Chang

(57) ABSTRACT

An electrical connector electrically connecting a chip module to a printed circuit board includes an insulative housing including a top insulative housing and a bottom insulative housing matched with the top insulative housing, a number of terminals received in the top insulative housing and the bottom insulative housing and at least one shielding plate fixed in the insulative housing and located beside the terminal, the electrical connector further employs a grounding plate assembled between the top insulative housing and the bottom insulative housing, the grounding plate electrically connects with the shielding plate and the shielding plate has a pair of clips fixed to the grounding plate.

11 Claims, 5 Drawing Sheets

ELECTRICAL CONNECTOR HAVING A GROUNDING PLATE FOR SHIELDING

BACKGROUND OF THE INVENTION

1. Field of the Invention

The present invention relates to an electrical connector, and more particularly to an electrical connector has a grounding plate for improving the shielding effect.

2. Description of the Related Art

An electrical connector electrically connecting a chip module to a printed circuit board is described in Chinese Patent issued No. 202194452, issued to WANG on Sep. 28, 2011. The electrical connector includes a socket body with a plurality of electrical contacts secured therein. The socket body also includes a grounding plate assembled on the insulative housing and the surface of the contact is covered with an insulating layer, then the insulating layer of the contact is plated with a shielding layer. The contact having a shielding plate contacts with the grounding plate. The structure of the socket body is complex and the plating process waste much time and it's so costly, furthermore, the shielding effect is bad.

Therefore, it is needed to find a new electrical socket to overcome the problems mentioned above.

SUMMARY OF THE INVENTION

Accordingly, an object of the present invention is to provide an electrical connector reducing the cost and getting better shielding effect.

In order to achieve the object set forth, an electrical connector electrically connecting a chip module to a printed circuit board includes an insulative housing including a top insulative housing and a bottom insulative housing matched with the top insulative housing, a number of terminals received in the top insulative housing and the bottom insulative housing and at least one shielding plate fixed in the insulative housing and located beside the terminal, the electrical connector further employs a grounding plate assembled between the top insulative housing and the bottom insulative housing, the grounding plate electrically connects with the shielding plate and the shielding plate has a couple of clips fixed to the grounding plate.

DESCRIPTION OF PREFERRED EMBODIMENT

Reference will now be made to the drawings to describe the present invention in detail.

Figure 1:
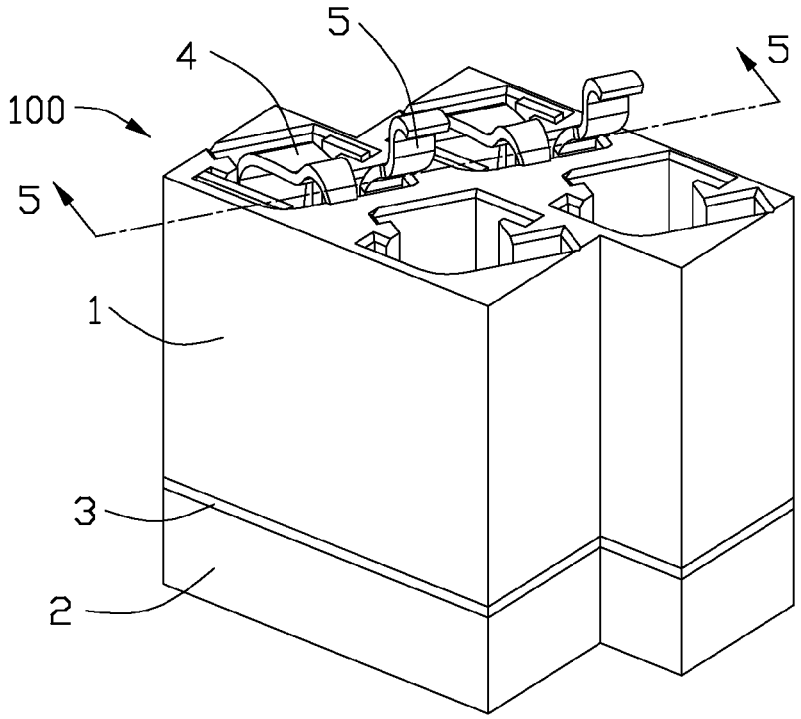
FIG. 1 is an isometric, assembled view of an electrical connector in accordance with a preferred embodiment of the present invention.
Figure 2:
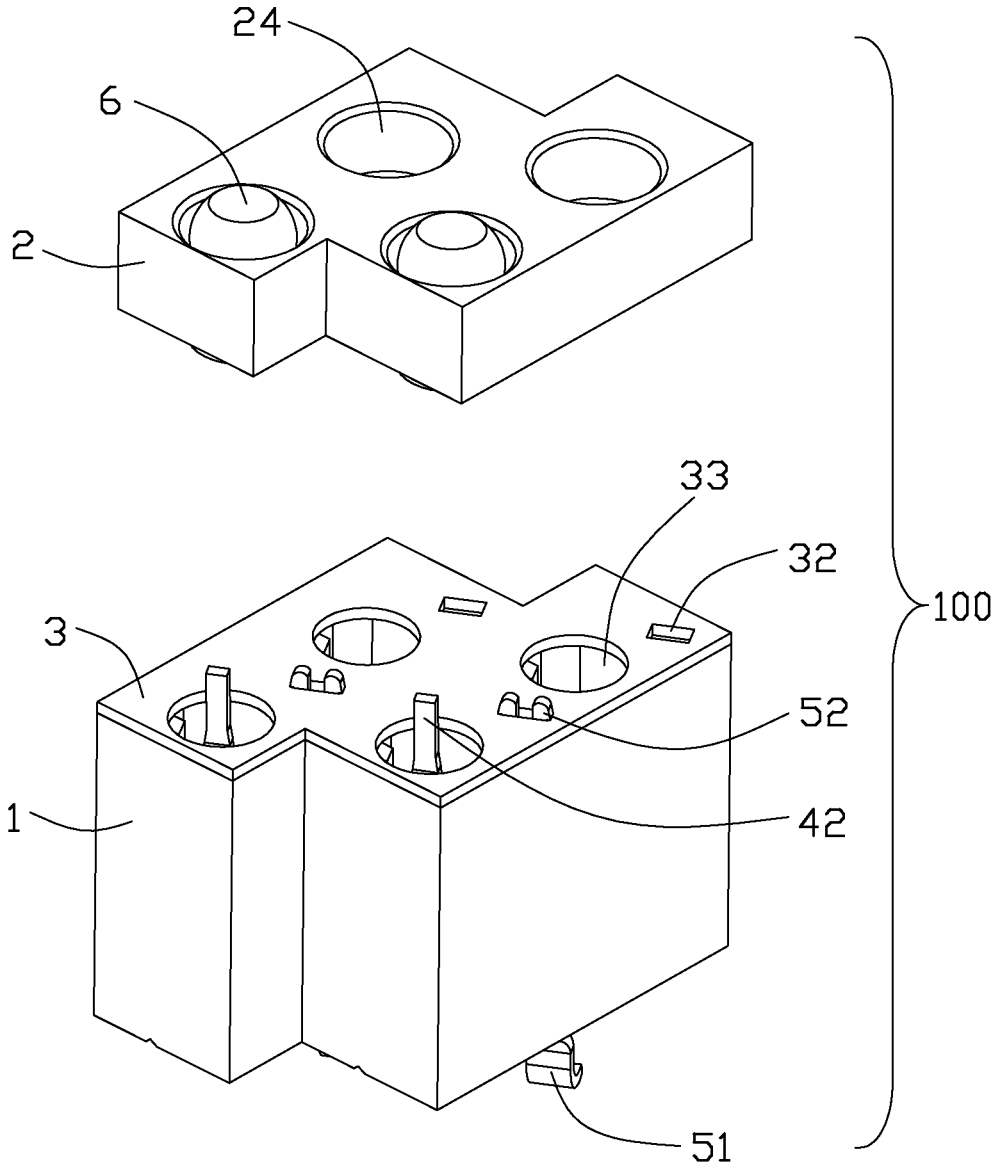
FIG. 2 is an isometric, partly assembled view of the electrical connector as shown in FIG. 1.

Referring to FIGS. 1-2, an electrical connector 100 according to the present invention is used to electrically connecting a chip module (not show) to a printed circuit board (not show) and comprises an insulative housing 1 with a plurality of terminals 4 received therein, a plurality of shielding plates 5 received therein and a plurality of solder balls 6 soldered the terminals 4 to the printed circuit board. The shielding plate 5 is located at a side of the terminal 4. The insulative housing 1 comprises a top insulative housing 1 and a bottom insulative housing 2 matched with the top insulative housing 1. The electrical connector 100 further comprises a grounding plate 3 assembled between the top insulative housing 1 and the bottom insulative housing 2.

Figure 3:
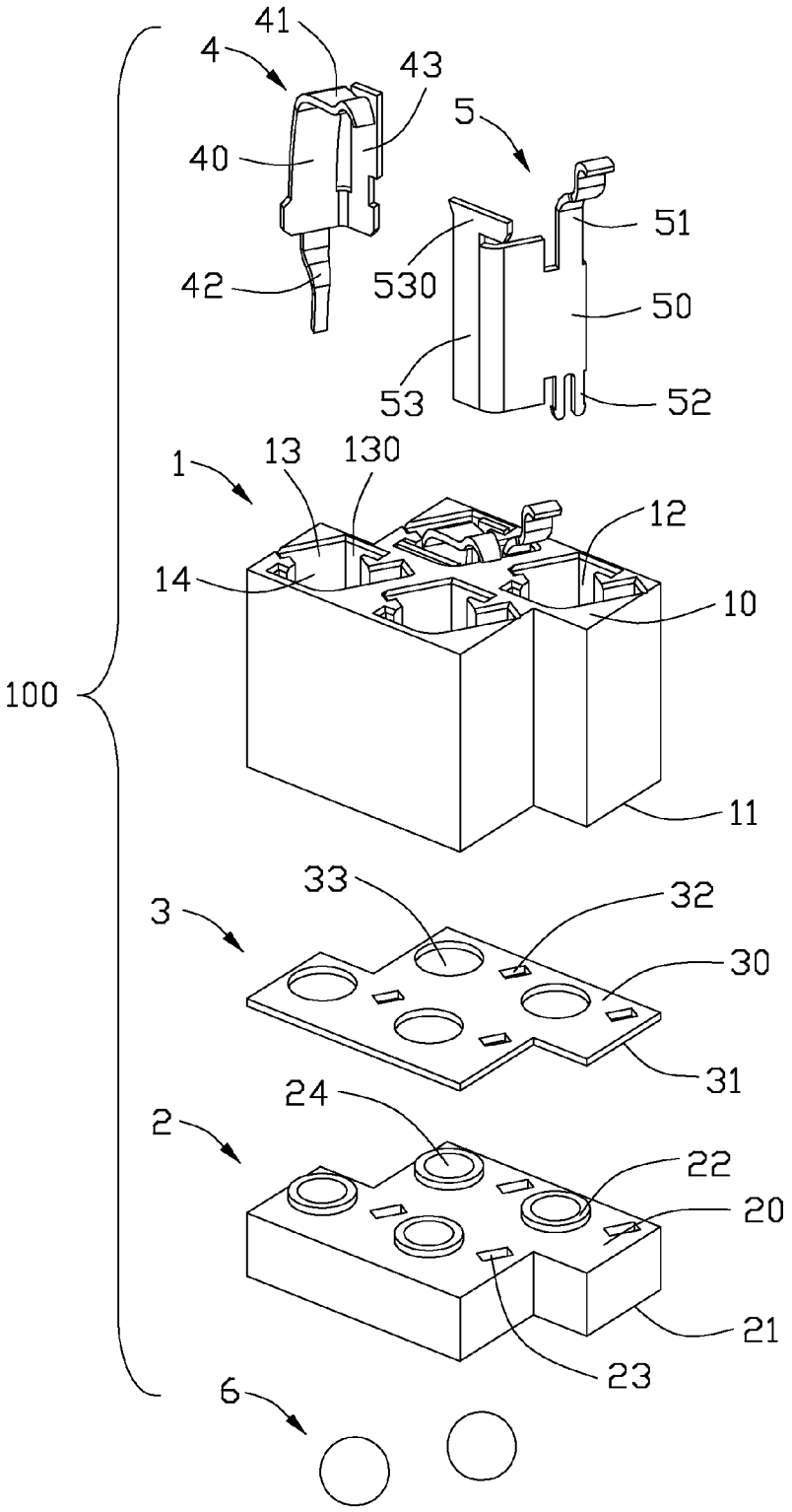
FIG. 3 is an exploded view of the electrical connector as shown in FIG. 1.
Figure 4:
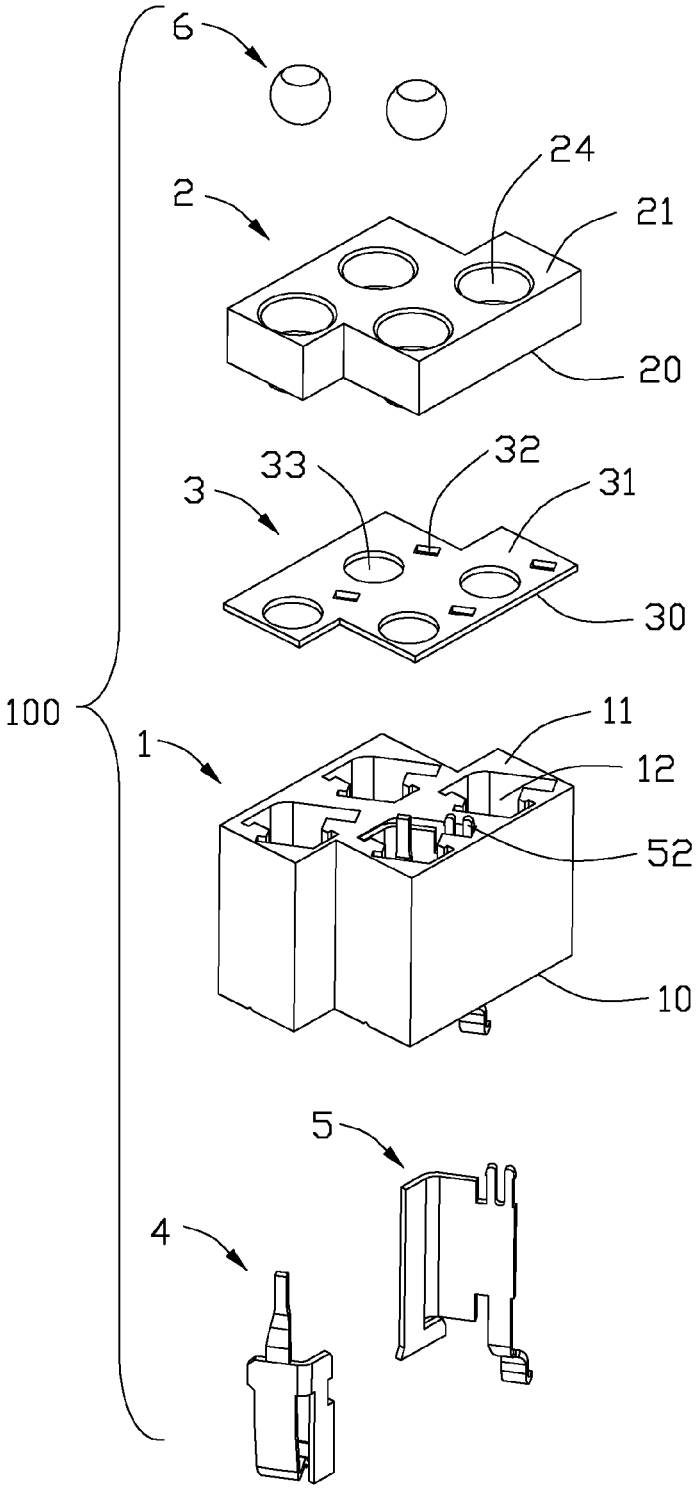
FIG. 4 is an another exploded view of the electrical connector as shown in FIG. 3.
Figure 5:
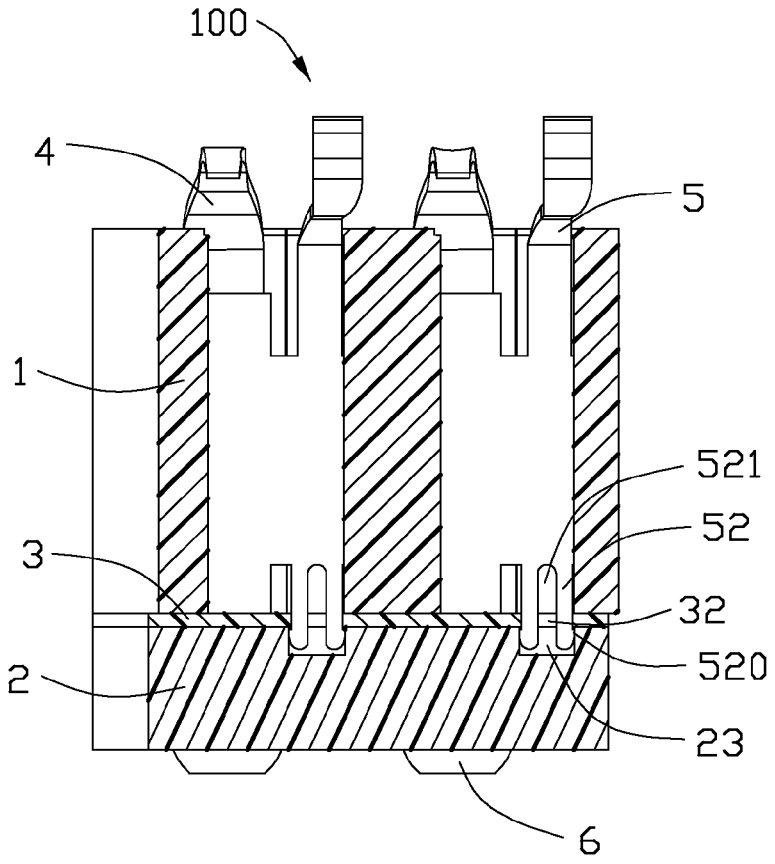
FIG. 5 is a cross-sectional view of the electrical connector taken along line 5-5 in FIG. 1.

Referring to FIGS. 3-4, the top insulative housing 1 comprises a first top surface 10, a first bottom surface 11 and a plurality of slots or passageways 12 penetrated from the first top surface 10 to the first bottom surface 11. The slot 12 comprises a first slot or passageway 13 and a second slot or passageway 14 in communicated with the first slot 13. The first slot 13 has a narrow slot 130 for fixing the terminal 4 and the narrow slot 130 is spaced with the second slot 14. Understandably, in an alternate embodiment the first slot 13 may not laterally communicate with the second slot 14 but isolated from each other via the housing The bottom insulative housing 2 comprises a second top surface 20, a second bottom surface 21 opposite to the second top surface 20 and a plurality of receiving slots 24 penetrated from the second top surface 20 to the second bottom surface 21. The bottom insulative housing 2 further comprises a plurality of bosses 22 protruding from the second bottom surface 21 and the receiving slot 24 penetrates through the boss 22. The bottom insulative housing 2 further comprises a recess 23 depressed from the second top surface 20.

Referring to FIGS. 3-4, the grounding plate 3 is configured with flat shape, and comprising a upper surface 30 and a lower surface 31 opposite to the upper surface 30. The grounding plate 3 further comprises a plurality of through slots 32 penetrated from the upper surface 30 to the lower surface 31 for receiving the shielding plate 5 and a plurality of through holes 33 penetrated from the upper surface 30 to the lower surface 31 for receiving the terminal 4. The through slots 32 corresponding to the slots 12 of the top insulative housing 1 and the recesses 23 of the bottom insulative housing 2.

The terminal 4 comprises a body portion 40, a contacting portion 41 bending upwardly from the body portion 40, a soldering tail 42 bending downwardly from the body portion 40 and a retention portion 43 bending outwardly from one side of the body portion 40. The shielding plate 5 comprises a base 50, a spring beam 51 bending upwardly from the base 50, a couple of clips 52 (and also as a contacting portion) extending downwardly from the base 50 and a supporting portion 53 bending outwardly from one side of the base 50. The supporting portion 53 comprises an extending portion 530 extending upwardly from the supporting portion 53 for receiving and retaining in the second slot 14. Each couple of the clips 52 has a pair of locking barbs 520 that buckled to the lower surface 31. Between the couple of clips 52 of the shielding plate 5 has an interval 521 and the clip 52 is elastic.

After assembling the electrical connector 100, the grounding plate 3 is assembled on the bottom insulative housing 2, the boss 22 is passed through by the through hole 33 and the top insulative housing 1 is assembled on the grounding plate 3. The terminal 4 is fixed in the top insulative housing 1, the soldering tail 42 passes through the through hole 33 and receives in the receiving slot 24 for contacting with the solder ball 6. The shielding plate 5 is fixed in the top insulative housing 1, the clip 52 is fixed to the grounding plate 3 and the locking barb 520 is locked by the lower surface 31.

The electrical connector 100 comprises a grounding plate 3 assembled between the top insulative housing 1 and the bottom insulative housing 2, the clip 52 is locked to the grounding plate 3 and then the shielding plate 5 is electrically contacted with the grounding plate 3, so, it combines a unity shielding net and it gets a whole shielding effect, furthermore, the grounding plate 3 assembled at the electrical connector 100 instead of assembled at the printed circuit board, and it can reduce the cost.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector electrically connecting a chip module to a printed circuit board, comprising:

an insulative housing comprising a top insulative housing with a plurality of slots and a bottom insulative housing with a plurality of receiving slots;

a plurality of terminals each received in the slot of the top insulative housing and the receiving slot of the bottom insulative housing; and wherein, at least one shielding plate disposed in the top insulative housing and located beside the terminal;

the electrical connector further comprises a grounding plate assembled between the top insulative housing and the bottom insulative housing, the grounding plate defined a plurality of through slots corresponding to the slots of the top insulative housing and the receiving slots, the shielding plate has a pair of clips fixed to the through slots of the grounding plate; herein said grounding plate is flat shape and comprising a upper surface and a lower surface opposite to the upper surface, the grounding plate comprises a plurality of through holes penetrated from the upper surface to the lower surface for receiving the shielding plates and the through slots penetrated from the upper surface to the lower surface for receiving the terminals; wherein said terminal comprises a body portion, a contacting portion bending upwardly from the body portion, a soldering tail bending downwardly from the body portion and a retention portion bending outwardly from one side of the body portion; wherein said bottom insulative housing comprises a second top surface, a second bottom surface opposite to the second top surface and a plurality of recesses depressed from the second top surface, the receiving slot penetrated from the second top surface to the second bottom surface, the bottom insulative housing further comprises a plurality of bosses protruding from the second bottom surface and the receiving slot penetrates through the boss; wherein said soldering tail passes through the through hole and extends to the receiving slot.

2. The electrical connector as claimed in claim 1, wherein each couple of the clips have a locking bard locked at the lower surface and there is an interval between the coupe of clips and the clip is elastic.

3. The electrical connector as claimed in claim 1, wherein said the top insulative housing comprises a first top surface, a first bottom surface opposite to the first top surface and the slot penetrated form the first top insulative housing to the first bottom surface, the slot comprises a first slot and a second slot communicated with each other, the first slot has a narrow slot for fixing the terminal and the second slot is spaced with the narrow slot.

4. The electrical connector as claimed in claim 1, wherein the shielding plate comprises a base, a spring beam bending upwardly from the base and a supporting portion bending outwardly from one side of the base, the couple of clips extending downwardly from the base.

5. An electrical connector electrically connecting a chip module to a printed circuit board, comprising:

a first insulative housing comprising a first top surface, a first bottom surface opposite to the first top surface and a slot penetrated from the first top surface to the first bottom surface, the slot comprises a first slot and a second slot communicated with each other, the first slot has a narrow slot and the second slot is spaced with the narrow slot;

a plurality of terminals received and fixed in the narrow slot of the first slot and comprising a body portion, a contacting portion bending upwardly from the body portion, a soldering tail bending downwardly from the body portion and a retention portion bending outwardly from one side of the body portion;

a plurality of shielding plate received in the second slot and located beside the terminals;

the electrical connector further comprises a second insulative housing and a grounding plate assembled between the first insulative housing and the second insulative housing, the shielding plate comprises a base, a beam extending upwardly from a end of the base and beyond the first top surface of the first insulative housing for electrically connecting to the chip module and a contacting portion extending downwardly from another end of the base for electrically connecting the grounding plate; wherein said contacting portion defines a pair of clips locked to the grounding plate and electrically connected to the grounding plate; wherein said grounding plate comprises an upper surface and a lower surface opposite to the upper surface, the grounding plate comprises a plurality of through slots and through holes penetrated from the upper surface to the lower surface for receiving the shielding plates and terminals respectively; wherein each of the clips have a locking bard locked at the lower surface and there is an interval between the coupe of clips and the clip is elastic.

6. The electrical connector as claimed in claim 5, wherein the shielding plate further comprises a supporting portion bending outwardly from one side of the base, the spring beam bending upwardly from the base and the couple of clips extending downwardly from the base.

7. The electrical connector as claimed in claim 5, wherein said bottom insulative housing comprises a second top surface, a second bottom surface opposite to the second top surface and a receiving slot penetrated from the second top surface to the second bottom surface, the soldering tail passes through the through hole and a part of soldering tail.

8. An electrical connector comprising:

an insulative upper housing defining opposite upper and lower surfaces;

a plurality of first passageways extending through the upper housing in a vertical direction;

a plurality of terminals received in the corresponding first passageways, respectively; each of said terminal defining an upper contacting section extending upwardly beyond the upper surface and a lower tail section extending downwardly below the lower surface;

a plurality of second passageways extending through the upper housing in said vertical direction and mixed with said first passageways;

a plurality of shielding plates disposed in the corresponding second passageways, respectively, each of said shielding plates defining at least a lower tail portion; and a metallic grounding layer disposed under the lower surface and electrically and mechanically contacting said lower tail portions; wherein the metallic grounding layer defines a plurality of through holes through which the lower tail sections of the terminals extend downwardly to connect to corresponding solder balls, respectively, for mounting to a printed circuit board under the first housing; further including an insulative lower housing located below the upper housing to sandwich the grounding layer therebetween in the vertical direction, wherein the solder balls are received in the lower housing; wherein one of said upper housing and said lower housing defines a plurality of bosses extending through the corresponding through holes in the vertical direction, respectively, for perfecting isolation between the terminals and the grounding layer.

9. The electrical connector as claimed in claim 8, wherein each of said shielding plates includes an upper contacting portion extending upwardly beyond the upper surface of the upper housing.

10. The electrical connector as claimed in claim 8, wherein the terminals and the shielding plates are paired with each other.

11. The electrical connector as claimed in claim 8, wherein said grounding plate further includes a plurality of through slots alternately arranged with said through holes to engage the corresponding lower tail sections of the terminals, respectively.

* * * * *